US011198977B2

(12) United States Patent
Eliot

(10) Patent No.: US 11,198,977 B2
(45) Date of Patent: Dec. 14, 2021

(54) BATCH ASPHALT MIX PLANT

(71) Applicant: A.L.M. Holding Company, Onalaska, WI (US)

(72) Inventor: Mark Eliot, Minnetonka, MN (US)

(73) Assignee: A.L.M. HOLDING COMPANY, Onalaska, WI (US)

( * ) Notice: Subject to any disclaimer, the term of this patent is extended or adjusted under 35 U.S.C. 154(b) by 364 days.

(21) Appl. No.: 16/086,793

(22) PCT Filed: Mar. 23, 2017

(86) PCT No.: PCT/US2017/023840
§ 371 (c)(1),
(2) Date: Sep. 20, 2018

(87) PCT Pub. No.: WO2017/165664
PCT Pub. Date: Sep. 28, 2017

(65) Prior Publication Data

US 2019/0100886 A1 Apr. 4, 2019

Related U.S. Application Data

(60) Provisional application No. 62/312,168, filed on Mar. 23, 2016.

(51) Int. Cl.
*E01C 19/00* (2006.01)
*E01C 19/08* (2006.01)
*E01C 19/10* (2006.01)

(52) U.S. Cl.
CPC ..... *E01C 19/08* (2013.01); *E01C 19/10* (2013.01)

(58) Field of Classification Search
CPC ..... E01C 19/08; E01C 19/1009; E01C 19/10
See application file for complete search history.

(56) References Cited

U.S. PATENT DOCUMENTS

| | | | |
|---|---|---|---|
| 3,239,643 | A | 3/1966 | Kluck |
| 3,665,141 | A | 5/1972 | Schiffmann et al. |
| 3,774,003 | A | 11/1973 | Kaufman |
| 3,856,275 | A | 12/1974 | Dydzyk |
| 4,176,267 | A | 11/1979 | Rueggeberg |
| 4,180,718 | A | 12/1979 | Hanson |
| 4,252,459 | A | 2/1981 | Jeppson |
| 4,253,005 | A | 2/1981 | Gordon et al. |
| 4,276,093 | A | 6/1981 | Pickermann |

(Continued)

FOREIGN PATENT DOCUMENTS

| | | | |
|---|---|---|---|
| CA | 2051445 | A1 | 10/1990 |
| CA | 2660700 | A1 | 2/2008 |

(Continued)

OTHER PUBLICATIONS

International Search Report for Application No. PCT/US2017/023840, dated Jul. 6, 2017, 6 pages.

(Continued)

*Primary Examiner* — Anshu Bhatia
(74) *Attorney, Agent, or Firm* — Kagan Binder, PLLC

(57) ABSTRACT

The present disclosure relates to a plant for manufacturing heated asphalt mix. In particular, the disclosure relates to a batch asphalt mix plant for using a microwave heating vessel located in close proximity to a storage silo to heat asphalt mix at the point of storage using a batch production method.

22 Claims, 17 Drawing Sheets

(56) References Cited

U.S. PATENT DOCUMENTS

| | | | | |
|---|---|---|---|---|
| 4,319,856 | A | 3/1982 | Jeppson | |
| 4,338,869 | A | 7/1982 | Hoskinson | |
| 4,488,027 | A | 12/1984 | Dudley et al. | |
| 4,619,550 | A | 10/1986 | Jeppson | |
| 4,861,955 | A | 8/1989 | Shen | |
| 5,083,870 | A | 1/1992 | Sindelar et al. | |
| 5,092,706 | A | 3/1992 | Bowen et al. | |
| 5,242,493 | A | 9/1993 | Glynn et al. | |
| 5,303,999 | A | 4/1994 | Nath et al. | |
| 5,447,388 | A * | 9/1995 | Rouse | B01F 3/1221 404/101 |
| 5,902,510 | A | 5/1999 | Balbaa et al. | |
| 6,186,700 | B1 | 2/2001 | Omann | |
| 6,207,462 | B1 | 3/2001 | Barclay et al. | |
| 6,455,826 | B1 | 9/2002 | Araya et al. | |
| 6,618,957 | B2 | 9/2003 | Novak et al. | |
| 6,768,089 | B2 | 7/2004 | Minobe et al. | |
| 7,432,483 | B2 | 10/2008 | Wilson | |
| 7,758,235 | B1 | 7/2010 | Collette | |
| 7,927,465 | B2 | 4/2011 | Novak | |
| 7,931,806 | B2 | 4/2011 | Logan et al. | |
| 8,101,893 | B2 | 1/2012 | Bogdan | |
| 8,586,898 | B2 | 11/2013 | Novak | |
| 9,624,625 | B2 | 4/2017 | Coe | |
| 9,642,194 | B2 | 5/2017 | Wilber et al. | |
| 10,081,920 | B2 | 9/2018 | Coe | |
| 10,214,786 | B2 | 2/2019 | Logan et al. | |
| 10,239,331 | B1 | 3/2019 | Gervais et al. | |
| 10,294,616 | B2 | 5/2019 | Crupi et al. | |
| 2002/0191481 | A1 | 12/2002 | Cox et al. | |
| 2007/0122235 | A1 | 5/2007 | Kasahara et al. | |
| 2010/0020630 | A1 * | 1/2010 | Musil | E01C 19/1063 366/4 |
| 2013/0343145 | A1 * | 12/2013 | Villalobos Davila | C10C 3/007 366/7 |
| 2014/0119829 | A1 * | 5/2014 | Eliot | E01C 23/065 404/113 |
| 2014/0146632 | A1 | 5/2014 | Eliot | |
| 2015/0164108 | A1 | 6/2015 | Logan et al. | |
| 2015/0237684 | A1 | 8/2015 | Huber | |
| 2018/0187385 | A1 | 7/2018 | Reinke et al. | |
| 2019/0017233 | A1 | 1/2019 | Coe | |

FOREIGN PATENT DOCUMENTS

| | | | |
|---|---|---|---|
| CN | 108547199 | A | 9/2018 |
| DE | 2627588 | B2 | 12/1977 |
| EP | 0529285 | A1 | 7/1992 |
| EP | 1611788 | A1 | 1/2006 |
| EP | 2689833 | A2 | 1/2014 |
| FR | 2522798 | A1 | 9/1983 |
| FR | 2755450 | A1 | 5/1998 |
| JP | 2008518930 | A | 6/2008 |
| KR | 101251102 | B1 | 4/2013 |
| WO | 1993009647 | A1 | 5/1993 |
| WO | 1996034241 | A1 | 10/1996 |
| WO | 2006050122 | A1 | 5/2006 |
| WO | 2006057563 | A1 | 6/2006 |
| WO | 2011036773 | A1 | 3/2011 |
| WO | 2013166489 | A1 | 11/2013 |
| WO | 2013166490 | A2 | 11/2013 |
| WO | 2017165664 | A1 | 9/2017 |
| WO | 2018154094 | A1 | 8/2018 |

OTHER PUBLICATIONS

Written Opinion for Application No. PCT/US2017/023840, dated Jul. 6, 2017, 7 pages.

Extended European Search Report for European Application No. 17771164.5, dated Dec. 10, 2019, 12 pages.

Extended European Search Report for 13785234.9 dated Jun. 28, 2016.

* cited by examiner

BATCH ASPHALT MIX PLANT

PRIORITY

This application claims priority to International Application No. PCT/US2017/023840, filed on Mar. 23, 2017, which claims the benefit of U.S. Provisional Patent Application No. 62/312,168, filed on Mar. 23, 2016, entitled "BATCH ASPHALT PLANT", the entire disclosures of which are incorporated by reference for all purposes.

BACKGROUND

A typical asphalt mix plant is comprised of a cold aggregate storage system. This can be a series of storage piles, or bins that hold the structural elements of asphalt, such as sand, crushed rock, mineral fillers, and the like, collectively referred to as aggregate. Additionally, Reclaimed Asphalt Pavement (RAP) or Reclaimed Asphalt Shingles (RAS) can be a component of an aggregate blend.

A liquid asphalt binder which is added to the aggregate or blend aggregate and RAP is stored in heated tanks. The liquid asphalt binder may be a PG graded binders identified by well-known ASTM D6373 or AASHTO M320 or M332 standards or an asphalt emulsion which meets grades identified by well-known ASTM D977 or D 2397 or AASHTO M140 or M208 standards. The asphalt emulsion may include any of a variety of softening or rejuvenating oils obtained from petroleum refining or derived from biological sources such as soybean, corn, flax seed, rape seed and other sources of seed oil. Additionally, bio-derived oils may be obtained from tree sources where tall oil (obtained as a by-product of the Kraft paper pulping process) may be used in crude, distilled, or in modified forms.

The aggregate is then fed into a drum dryer heater, to which is added RAP (if used) and the asphalt binder. The drum dryer heater heats, dries and mixes the components to produce the finished asphalt mix. This drum mix process is well known in the bituminous paving industry. Bituminous mix plants known as batch plants may accomplish the same finished asphalt mix and although the process is not used as widely today the batch plant mixing procedure is also well known in the paving industry.

The drum mixer is typically heated with an open flame burner using a fuel source, such as natural gas, LP gas, or fuel oils ranging from #2 through #6 or slurry oil.

The finished asphalt mix is then normally conveyed to a storage silo, and then dispensed as needed into trucks that take the finished asphalt to an application site.

Such plants may also include dust collectors, a bag house to remove harmful or volatile particulates, screens, scales, bitumen storage system, heaters for maintaining asphalt binder at usable temperatures, or an onsite generator for power unless power is commercially available for the plant.

Thus, asphalt mix plants require a great deal of infrastructure and special air pollution permitting. They need to be able to produce large volumes of asphalt to justify the expense; however, the demand for asphalt in most of the country is seasonal and/or sporadic. In the winter, in colder climates, it may not be possible to produce and supply asphalt; and as a result plants may shut down for a large portion of the year. These economics place constraints on when and where asphalt can be produced.

Another type of plant comprises a portable asphalt mix plant. Portable asphalt mix plants are similar to the plant described above, but typically would include one or two silos for storage and the asphalt mix produced is for a specific project. In some circumstances, the portable plant can be operated at a remote site and provides asphalt mix to customers on an as needed basis. Other plants may use some form of a silo at the end of the process to store a "batch" of finished asphalt mix of predetermined size that can be loaded, for example, into a truck.

As noted above, because of the cost of fixed site plants, the long hauling distances from permanent plants to the job site, and the sometimes infrequent demand for asphalt, portable plants may be set up to meet a specific short term need. For example, smaller municipalities, or counties, may have a small demand for asphalt at any given time, that would not justify a permanent plant, and instead they save up the demand and then use a portable plant every few years or as needed to make the asphalt or bituminous mix.

This is not an optimal situation, as the plants are still expensive to move, setup, and take down, and the need to wait until sufficient capacity has built up means that needs may be unmet for years before the demand justifies setting up a portable asphalt mix plant.

In some situations, the raw materials may not need to be stored on site, and especially with the portable asphalt mix plants, the raw materials must be brought on site in bulk quantity or in what are known as super sacks. Super sacks are large bags of aggregate, treated aggregate, reclaimed asphalt pavement (RAP), and other raw materials typically used in an asphalt mix in the range of 2,000 to 5,000 pounds. These super sacks may be brought to the mix site as needed.

In any event, substantial infrastructure is still needed, which is expensive and time consuming to set up, move, and/or maintain. This is especially the case when even under the best of conditions the asphalt mix plant may be idle a great deal of the year due to weather or demand issues. Thus, a need exists for a batch asphalt mix plant that eliminates the drawbacks of the prior art.

SUMMARY OF THE INVENTION

The present disclosure relates to a plant for manufacturing finished asphalt mix (in Europe, asphalt mix or finished asphalt mix are typically referred to as bituminous mix or finished bituminous mix; those skilled in the art readily understand this distinction). In particular, the disclosure relates to a batch asphalt mix plant for using a microwave heating vessel located in close proximity to a heated storage silo to maintain temperature of the finished asphalt mix at the point of production One embodiment is a mobile batch asphalt mix plant comprising a flatbed trailer, an electric generator mounted the trailer, a microwave energy system powered by the generator, wave guides directing microwave energy into one or more heating vessels, a conveyor and dragline to move unheated asphalt from a hopper to the heating vessel, and a silo for storing asphalt heated in the heating vessel with microwave energy.

In some embodiments the microwave energy system comprises a single microwave transmitter; in other embodiments the microwave energy system comprises a plurality of microwave transmitters.

In other embodiments the heating vessel contains agitation mechanisms to mix the asphalt during heating. One embodiment of an agitation mechanism a plurality of paddles that move the asphalt from one side of the heating vessel to the other side during heating. Another embodiment of an agitation mechanism is a pug mill to mix the heated asphalt before being moved the silo for storage.

Another embodiment is a stationary batch asphalt mix plant comprising a source of electricity, a microwave energy system powered by the source of electricity, wave guides directing microwave energy into one or more heating vessels, a conveyor and dragline to move unheated asphalt from a hopper to the heating vessel, and a silo for storing asphalt heated in the heating vessel with microwave energy.

Still another embodiment is a modular batch asphalt mix plant with a low energy heating system comprising two T-shaped wings, wherein a first wing houses various facility components comprising a microwave energy system and a microwave heating vessel; and a second other wing comprises three or more modular silos for storage of heated asphalt.

An embodiment of a process for using a batch asphalt mix plant described in this disclosure to produce a finished asphalt mix comprises the steps to moving an asphalt mix from a hopper to a microwave heated batcher, heating the asphalt mix in the microwave heated batcher to a predetermined temperature using only microwave energy to provide a finished asphalt mix, and moving the finished asphalt mix to a silo for storage. In some embodiment the asphalt mix comprises aggregate, treated aggregate, RAP, RAS or combinations thereof.

In all disclosed embodiments, heated, liquefied asphalt binder (bitumen) or asphalt emulsion (generally referred to as a binder component) may added to the aggregate, treated aggregate, RAP, RAS or combinations thereof (generally referred to as an aggregate component) prior to introducing the combined aggregate component and binder component into the microwave heated batcher and mixing systems described below. The binder component may be added to the aggregate component well in advance of or just prior to the microwave heating and mixing procedure or at the time of actual production. A heated, liquefied asphalt binder could be added directly to the aggregate or in the form of foamed bitumen. A pug mill mixer could be used to incorporate the binder component into the aggregate component, although it is understood that intimate mixing of binder and aggregate is not accomplished as this stage.

DETAILED DESCRIPTION OF THE INVENTION

Figure 1:
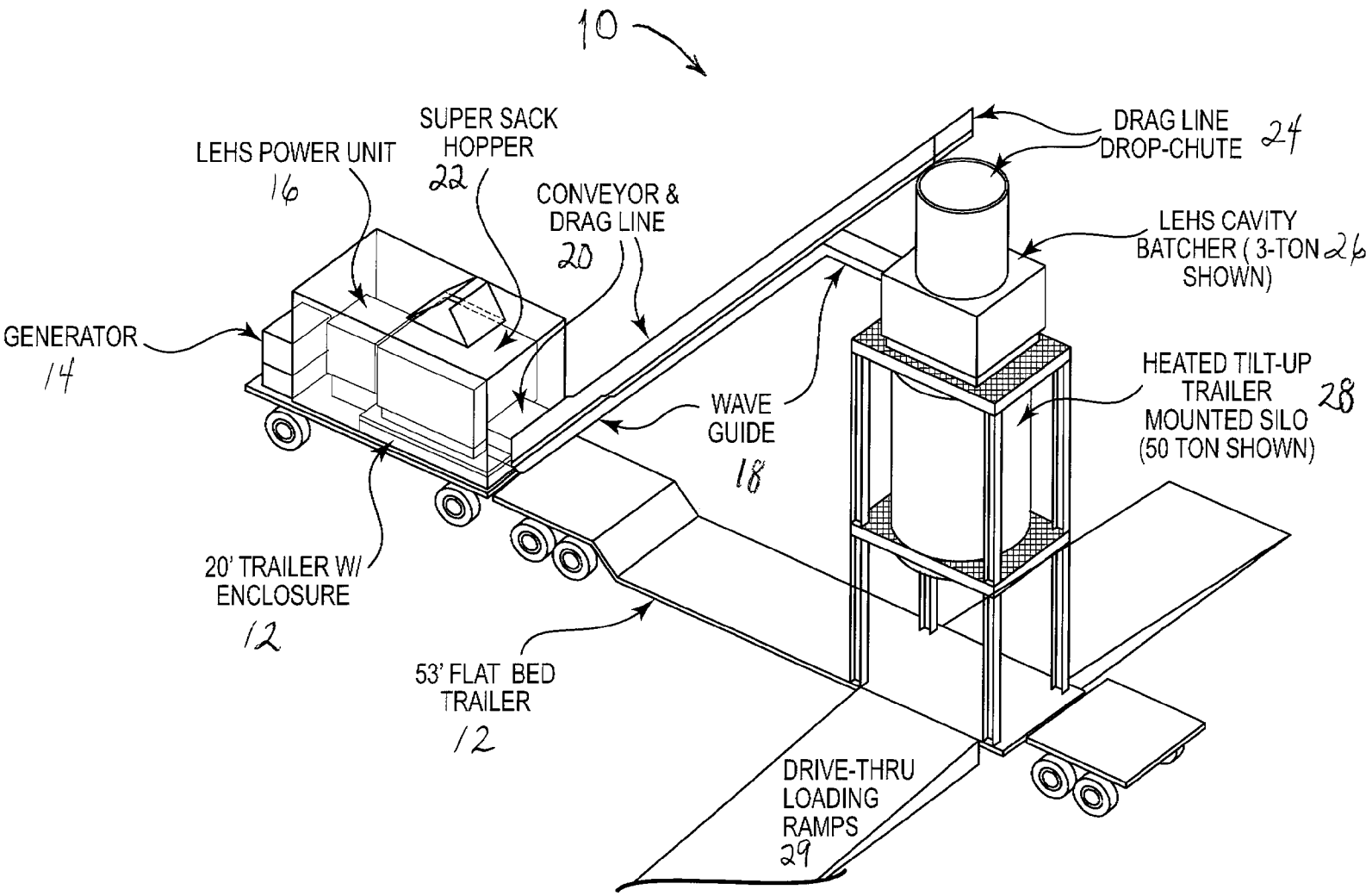
FIG. 1 is a perspective view illustrating an embodiment of a mobile asphalt mix plant with a Low Energy Heating System ("LEHS").

FIGS. 1-17 illustrate embodiments of an asphalt mix plant having a vessel comprising a microwave heated batcher, embodiments of an asphalt mix plant having a vessel consisting essentially of a microwave heated batcher, embodiments of an asphalt mix plant having a vessel consisting of a microwave heated batcher. In particular, FIG. 1 shows the general configuration of an embodiment of the present description. This embodiment comprises a mobile version of an asphalt mix plant 10. The asphalt mix plant 10 includes a flatbed trailer 12 upon which components of the asphalt mix plant are mounted, and which can be towed from site to site. In other embodiments, an asphalt mix plant may be a stationary mini asphalt mix plant that can be mobile, or stationary.

An electrical generator 14 is located on the trailer 12 to provide electricity to power the plant, or a connection for house power is provided (which is especially useful with the stationary plant configuration). The generator 14 can run on a variety of fuels such as diesel, fuel oil, gasoline, natural gas, and the like. Also, provided is a microwave energy system 16, and in particular a Low Energy Heating System ("LEHS"), wherein a LEHS power unit powers a plurality of microwave transmitters. The LEHS power unit typically includes a plurality of microwave transmitter units (not shown) with a splitter/wave guides that direct microwave energy from each transmitter into one or more rotary head heating chambers, stationary corporate wave guides can also be used, using either 2.4 GHz or 915 MHz. The microwave process is referred to in this disclosure as LEHS or as a mobile low energy heating system ("MLEHS"). Using a single or multiple microwaves transmitters in a series gives the ability to cycle the power and intensity to achieve the best heating results over a controlled surface. The microwave energy in FIG. 1 is channeled through a wave guide 18 that runs along the side of, or under, a drag line (slat conveyor) 20 (explained in detail below).

A hopper is provided where unheated aggregate or a mixture of unheated aggregate and RAP (or alternatively RAS) is loaded. This aggregate material may be loaded from stockpiles using a front end loader or in some instances may be brought to a mixing site in super sacks 22. In some embodiments, the aggregate is combined or treated with an emulsified asphalt binder when it is used in the disclosed batched asphalt mix plant.

Figure 2:
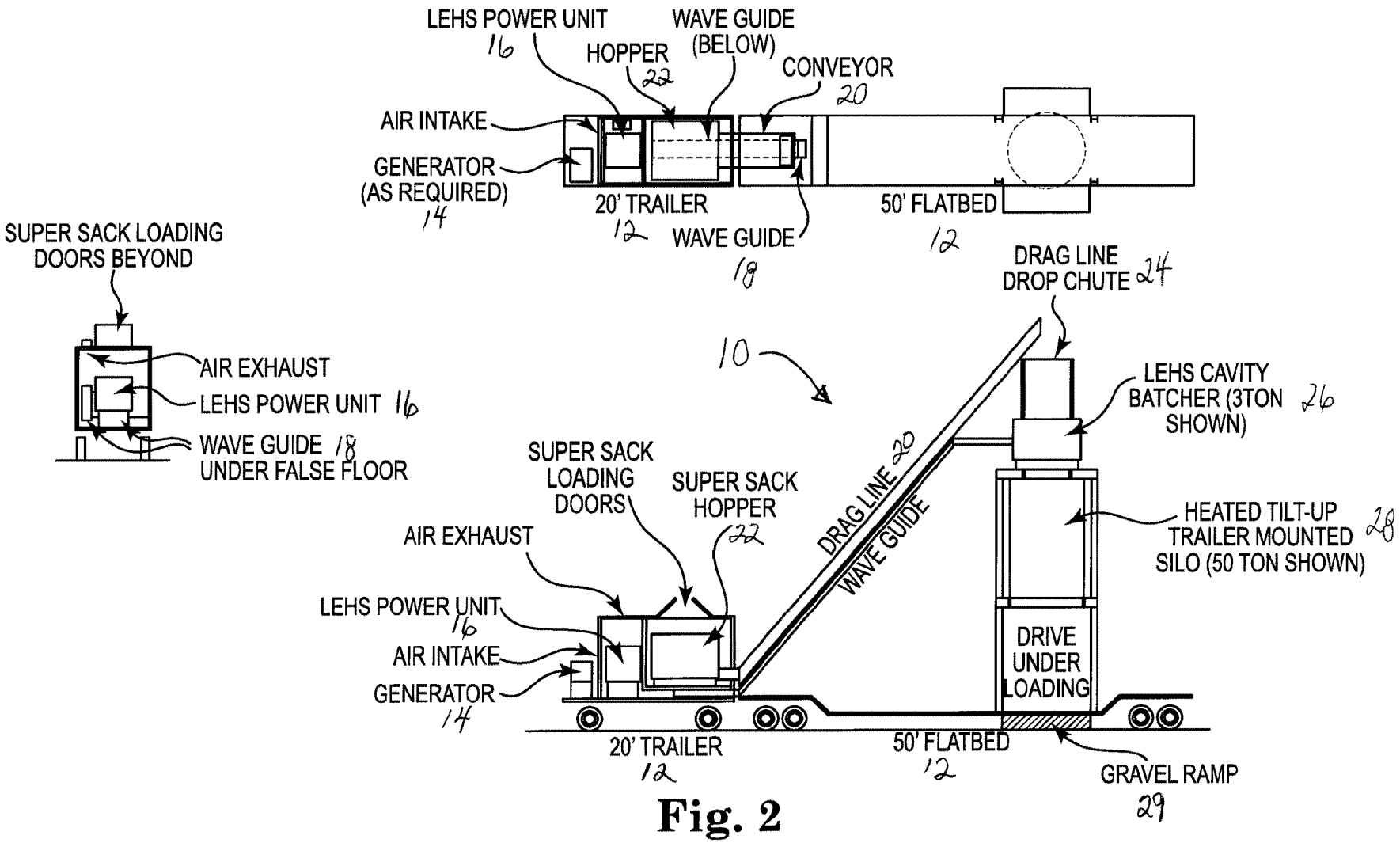
FIG. 2 illustrates top, front and side views of the mobile asphalt mix plant shown in FIG. 1.

The aggregate material is carried along the top of drag line (slat conveyor) 20, where it then falls into a drop chute 24, and then into the LEHS batcher 26. The batcher 26 receives the microwave energy from the wave guide 18. The asphalt mix is heated in the batcher 26 and the entire batch is then delivered to a silo 28. The finished asphalt mix can be stored in the silo until it is loaded into a truck. In another embodiment, the heating vessel is designed without any agitation mechanism and instead uses additional wave guide splits (not shown) that can be mounted either on the top of the silo or on the ground where heating can occur, and then conveyance of the heated material to the silo for storage. Ramps 29 are provided (or gravel can be used) to allow the truck to move under the silo for material loading. The silo 28 is on a tilt-able mount and can be moved to a flat position on the trailer for transportation. FIG. 2 shows additional views of the asphalt mix plant shown in FIG. 1.

Figure 3:
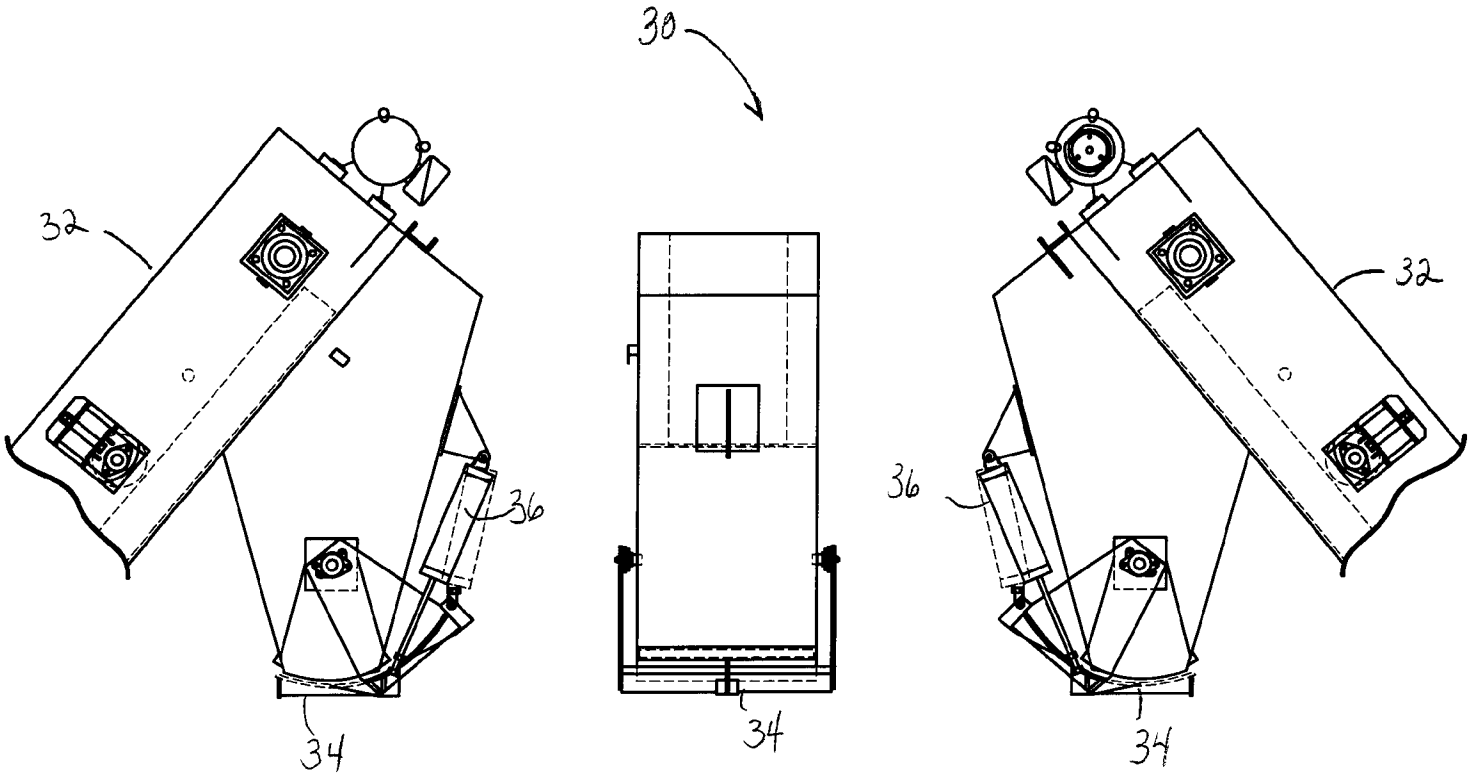
FIG. 3 illustrates an alternative embodiment of a batcher for use with the mobile asphalt mix plant of FIG. 1.

FIG. 3 shows various views of a batcher 30 that can substituted for the drop chute shown in FIGS. 1 and 2. The batcher 30 is affixed to the terminal end of slat conveyor 32. In particular, asphalt mix is dropped from the conveyor 32 into the batcher, which when full is emptied by opening the hinged door 34 at the bottom of the batcher 30. The door 34 is moved by a hydraulic cylinder(s) 36 that moves the door between an opened and closed position. Microwave energy can be directed to the batcher in the manner shown in reference to FIGS. 1 and 2. A wave guide (not shown in FIG. 3) can be attached to the slat conveyor 32, and the energy released into the interior of the batcher 30.

Figure 4:
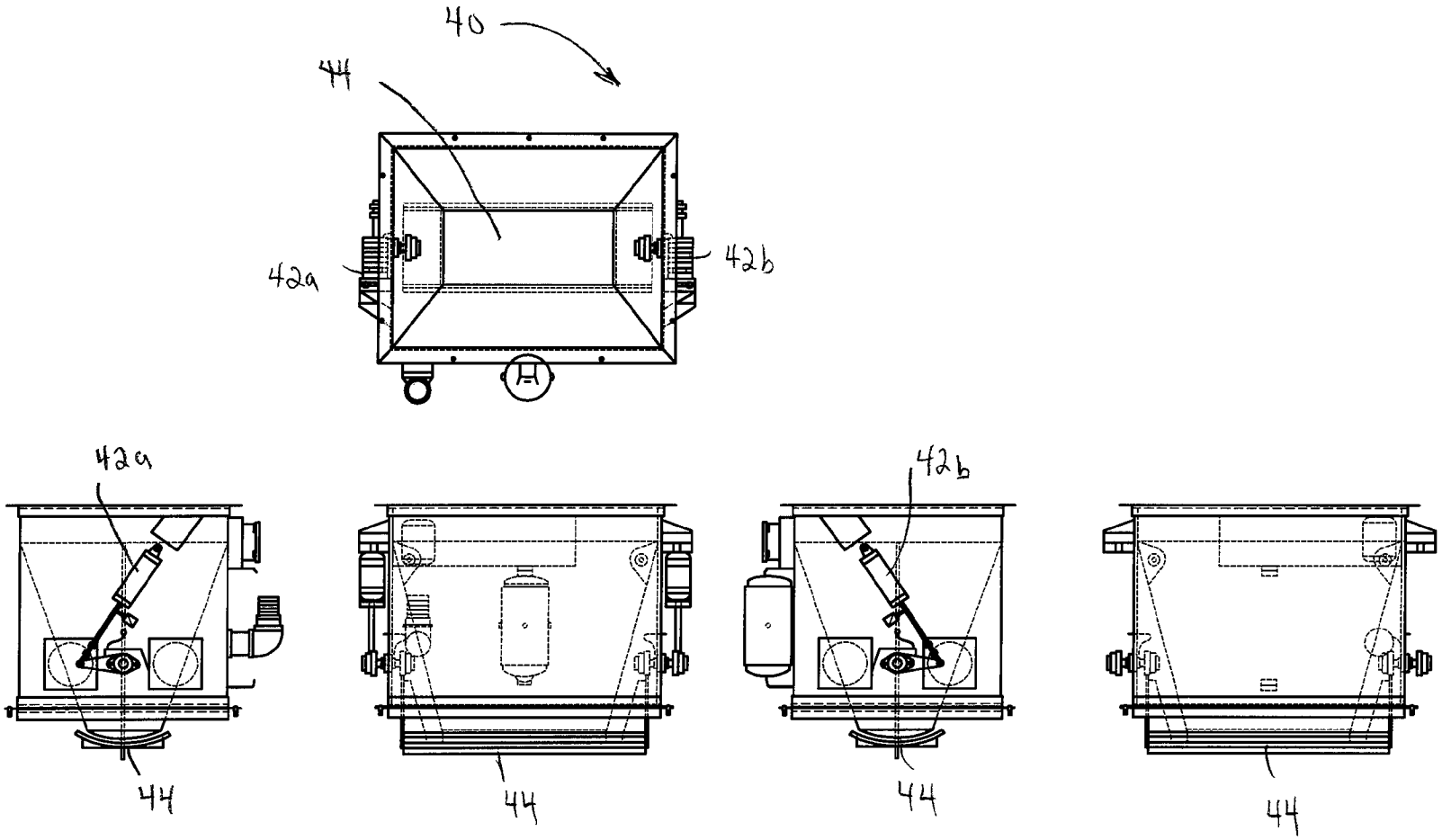
FIG. 4 illustrates another alternative embodiment of a batcher for use with the mobile asphalt mix plant of FIG. 1.

FIG. 4 shows various views of another batcher 40 that can be used with the mobile asphalt mix plant illustrated in FIGS. 1 and 2. The batcher would receive asphalt mix from a dragline (slat conveyor) (not shown in FIG. 4), but does not necessarily have to be physically connected to the conveyor as illustrated in FIG. 3. Two hydraulic cylinders 42*a* and 42*b* on opposite sides of the batcher 40 open and close a swinging door 44 at the bottom of the batcher. Microwave energy can be directed to the interior of batcher as described above.

Figure 5:
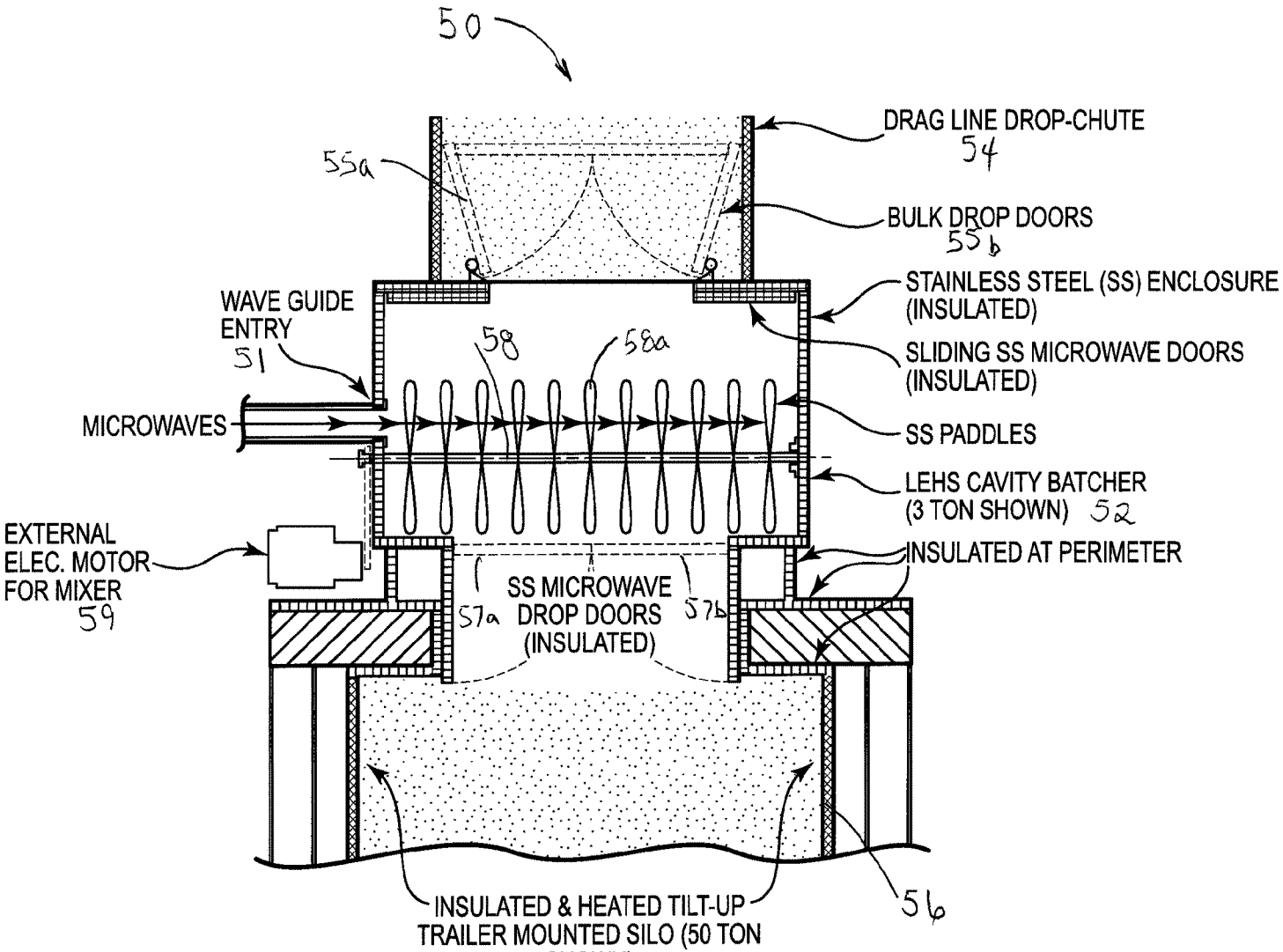
FIG. 5 illustrates an embodiment of a batcher for use with an asphalt mix plant.

FIG. 5 shows another embodiment of a batcher 50 that comprises an LEHS cavity 52 between the bulk drop container 54 and the silo 56. The bulk drop container 54 includes bulk drop doors 55*a* and 55*b* which when open allow asphalt mix in the container 52 to fall into the LEHS cavity 54. Further, stainless steel doors 57*a* and 57*b* at the top of the silo can be opened and closed to receive finished asphalt mix either in batches or continuously. The LEHS cavity is preferably constructed of stainless steel which is not magnetic and is not a good conductor of microwave energy making it suitable for use with microwaves; other similar materials can be used such as aluminum (for example).

In order to more effectively heat the material a mixer 58 is provided, having a plurality of paddles 58*a* (preferably stainless steel) that move the material from one side of the cavity to the other and back again. In another embodiment, this mixing can occur outside the LEHS cavity, with a detached mixer (not shown). The mixer 58 is powered by motor 59 attached to the side of the LEHS cavity. Microwave energy enters the LEHS cavity through a wave guide 51. After the bituminous mixture is heated by the microwave energy, the mixture is dropped through doors 57*a* and 57*b* at the bottom of the LEHS cavity into the silo for storage and eventual distribution.

In one embodiment, the asphalt mix plant is mobile; however, the disclosed microwave batcher/cavity can be adapted to a stationary asphalt mix plant as well. The asphalt mix plant can be used with super sacks of aggregate, treated aggregate, with some percentage RAP (including up to 100% RAP), RAS or combinations thereof. Depending on the anticipated amount of finished asphalt mix needed, the time of year, and geographical location the aggregate, treated aggregate, RAS and/or RAP can be stockpiled outside or inside a building. The microwave batcher cavity or vessel is adapted for heating batch sizes in the range of 1 to 4 tons of bituminous mixture, which is typically heated to a temperature in a range of about 280° F. to 325° F. The target heating temperature will vary depending on the type of bituminous mixture or asphalt used, the time of year, and hauling distance and in some instances could be outside the typical target temperature range stated above. The silo can hold in the range of 50-75 tons of finished asphalt mix.

As shown above the disclosed asphalt mix plant may include a microwave heating vessel that is attached to the end of the conveyor, that sits between the slat conveyor and silo but is attached to the silo, or alternatively the heating vessel can be located in the silo itself. In particular, the heating vessels illustrated in FIGS. 1, 2, and 5 can be recessed into the actual silo rather than located at a site above the silo.

Figure 6:
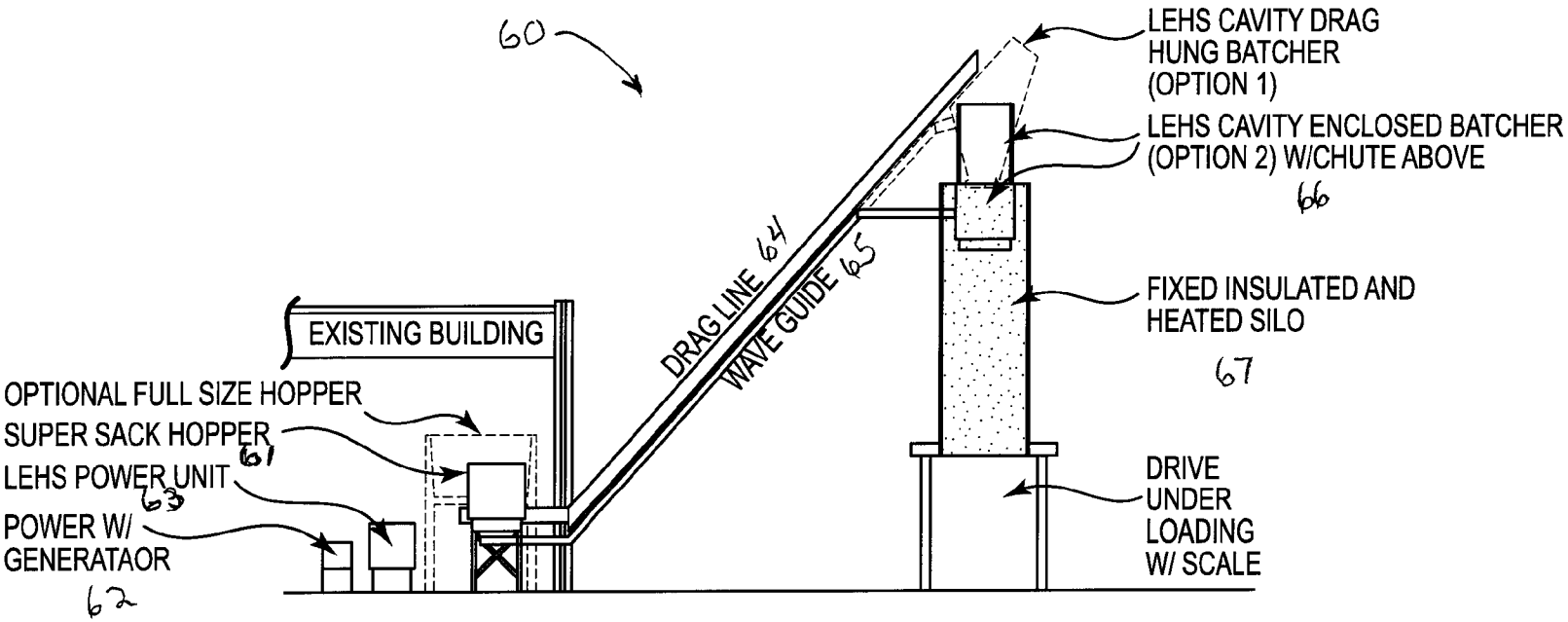
FIG. 6 is a side view illustrating an embodiment of a stationary asphalt mix plant with a LEHS.

FIG. 6 shows a stationary version of the asphalt mix plant 60, which is substantially similar to the mobile version but can be fixed to a particular location. The stationary version includes a hopper 61 that can accommodate aggregate, treated aggregate, RAP, RAS or combinations thereof mixed on site, or similar materials loaded from super sacks. A power generator 62 and LEHS power unit 63 are located at ground level. A drag line (slat conveyor) 64 moves aggregate, treated aggregate, RAP, RAS or combinations thereof up to the batcher, and a wave guide 65 runs along the underside of the drag line 64 to channel the microwave energy upward as well. As with the mobile plant, the stationary plant can use a batch heating vessel 66 located at the end of the drag line (slat conveyor), or a vessel that is attached to or enclosed within the silo 67.

Figure 7:
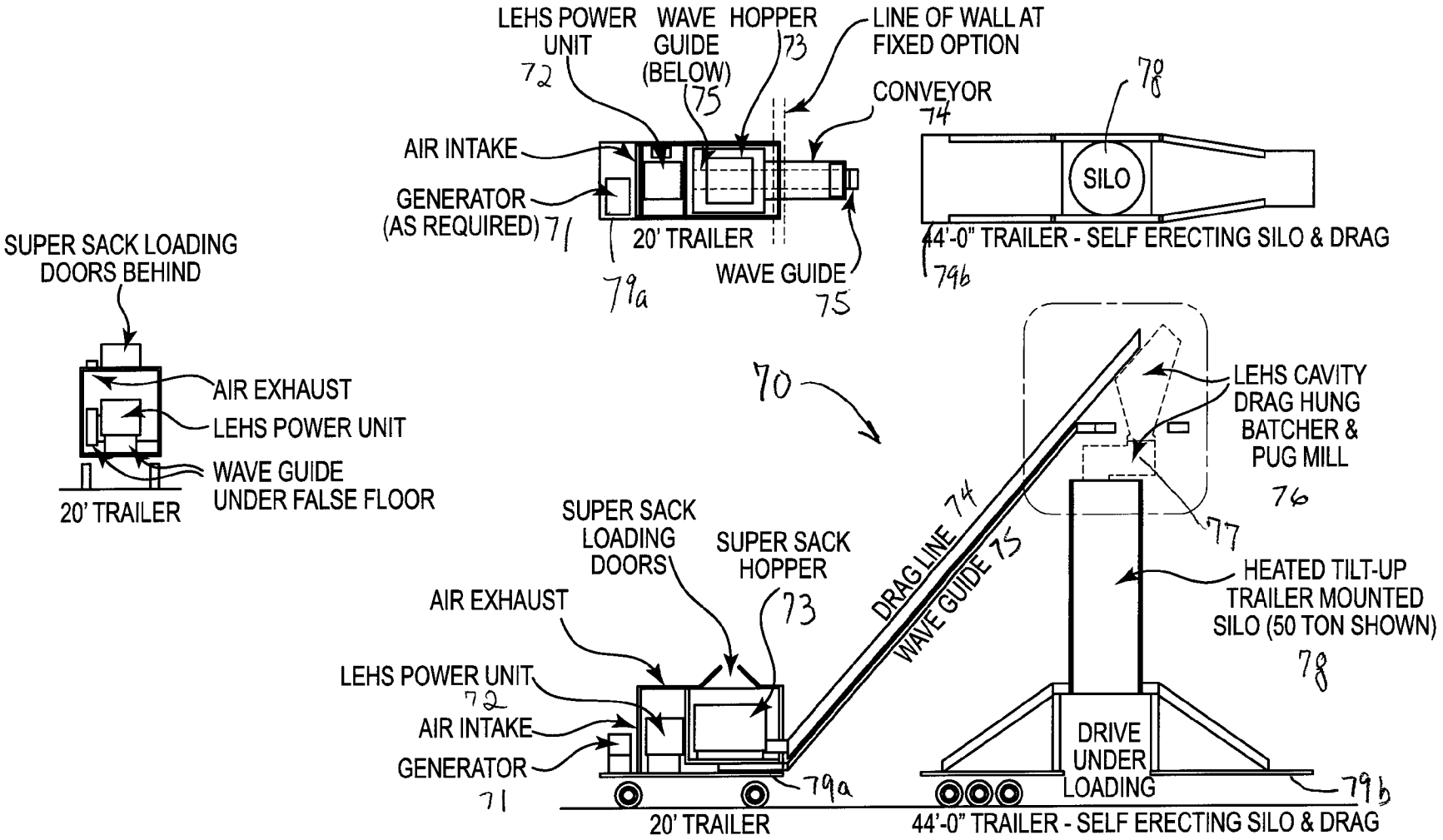
FIG. 7 is side, front and top views of a mobile asphalt mix plant with a LEHS.

FIG. 7 illustrates an embodiment of a mobile version of the asphalt mix plant 70, which includes a mobile power unit housing a generator 71 and the LEHS microwave power plant 72, and an aggregate, treated aggregate, RAP, RAS or combinations thereof loader 73. The aggregate, treated aggregate, RAP, RAS or combinations thereof is moved up a drag line (slat conveyor) 74, with the wave guides 75 mounted under the drag line (slat conveyor). A batch heating vessel 76 receives aggregate, treated aggregate, RAP, RAS or combinations thereof from the drag line (slat conveyor) 74 and microwave energy is directed into the LEHS cavity through various distribution conduits arranged in a ring around the vessel. The finished asphalt mix after being heated moves from the vessel into a pug mill 77 that uses paddles to mix the finished asphalt mix, which then moves into a silo 78. The entire plant is mounted on one or more trailers 79*a* and 79*b*, and can be moved as needed.

Figure 8:
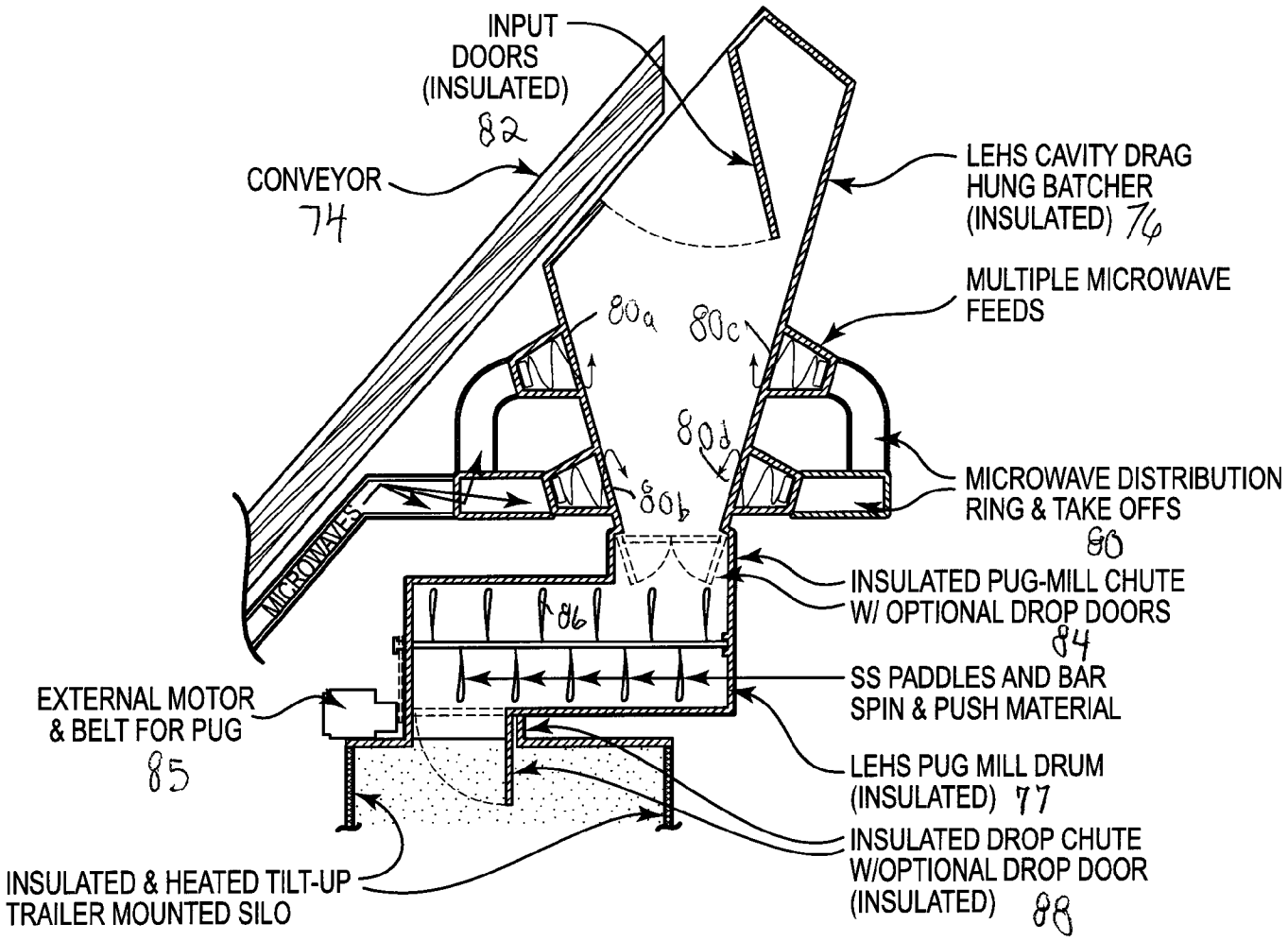
FIG. 8 is close up side view of the batch heating vessel and pug mill of FIG. 7.

FIG. 8 is a close up view of the batch heating vessel 76 and pug mill 77 of FIG. 7. The microwave energy is channeled into a ring 80 that allows the energy to be evenly distributed into various input feed take off chutes 80*a*, 80*b*, 80*c* and 80*d*, so that the energy enters the vessel from a number of distributed areas. Doors 82 at the top of the vessel/cavity can be opened and closed to receive and heat a batch of aggregate, treated aggregate, RAP, RAS or combinations thereof. Doors 84 at the bottom of the vessel are similarly opened and closed to move the heated aggregate, treated aggregate, RAP, RAS or combinations thereof, and optional asphalt binder (if needed or used) to the pug mill 77 for mixing. A motor 85 drives paddles 86 that mixes the heated aggregate, treated aggregate, RAP, RAS or combinations thereof, and optional asphalt binder (if needed or used) to more evenly distribute the heat, and then the finished asphalt mix in the pug mill drops through doors 88 into the silo 78 below. All of the areas that receive or process heated aggregate, treated aggregate, RAP, RAS or combinations thereof, and optional asphalt binder (if needed or used) are insulated to prevent heat loss, or are provided with a jacket that is heated with circulating oil.

Figure 9:
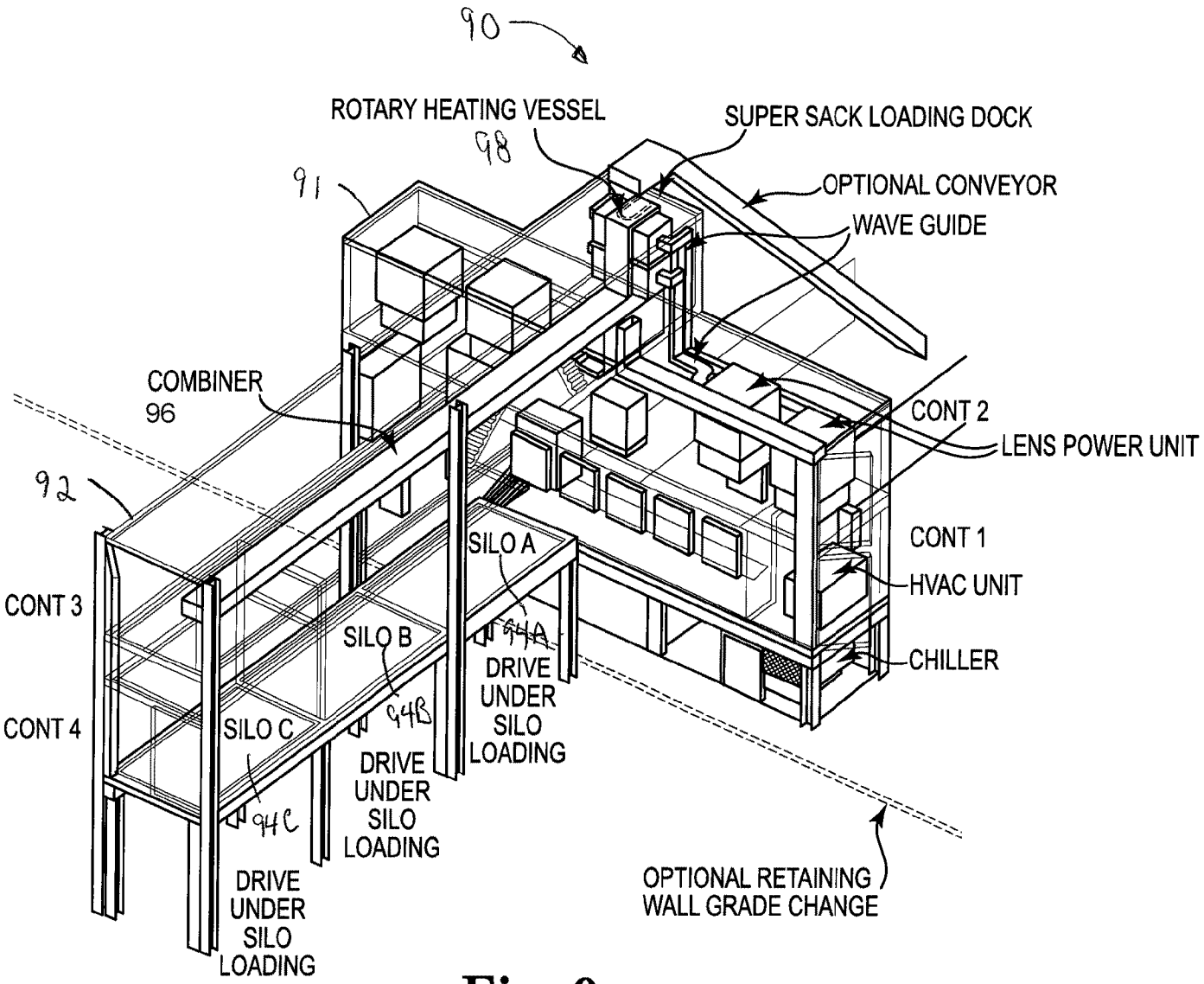
FIG. 9 illustrates an alternative embodiment of a modular asphalt mix plant with a LEHS.

FIG. 9 shows an alternative embodiment of an asphalt mix plant with a LEHS comprising a modular asphalt mix plant. The disclosed asphalt mix plant 90 includes two T-shaped wings 91 and 92. Generally, one wing 91 houses various facility components primarily related to microwave operation 91, and the other wing 92 comprises a series of silos for storage of the finished asphalt mix.

In particular, this figure illustrates 3 modular silos (labeled 94A, 94B, 94C and shown transparently in FIG. 9); however, more or less silos can be included. The silos allow for dispensing finished asphalt mix into trucks that can drive under the silos. Load cells are incorporated under the silos to weigh finished asphalt mix as it is dispensed.

Finished asphalt mix is moved to the silos by a combiner 96, which uses a series of paddles (not shown) to move and mix the finished asphalt mix from the microwave rotary heating vessel 98 to the silos 94A, 94B and 94C. Drop chutes (not shown) located on the underside of the combiner allow the finished asphalt mix to drop from the combiner into the chosen silo. The drop chutes can be mechanically operated to allow for selection between the silos, such that the silos can be filled on demand. For example, diverters can be used to channel the flow of the finished asphalt mix to the appropriate drop chute and silo. The silos, as well as the combiner are wrapped in insulated jackets, and an oil boiler (or similar system) can be used to circulate hot oil thereto to ensure that the finished asphalt mix is kept at a stable elevated temperature after leaving the microwave vessel in a target temperature range of about 280° F. to 325° F.

Figure 10:
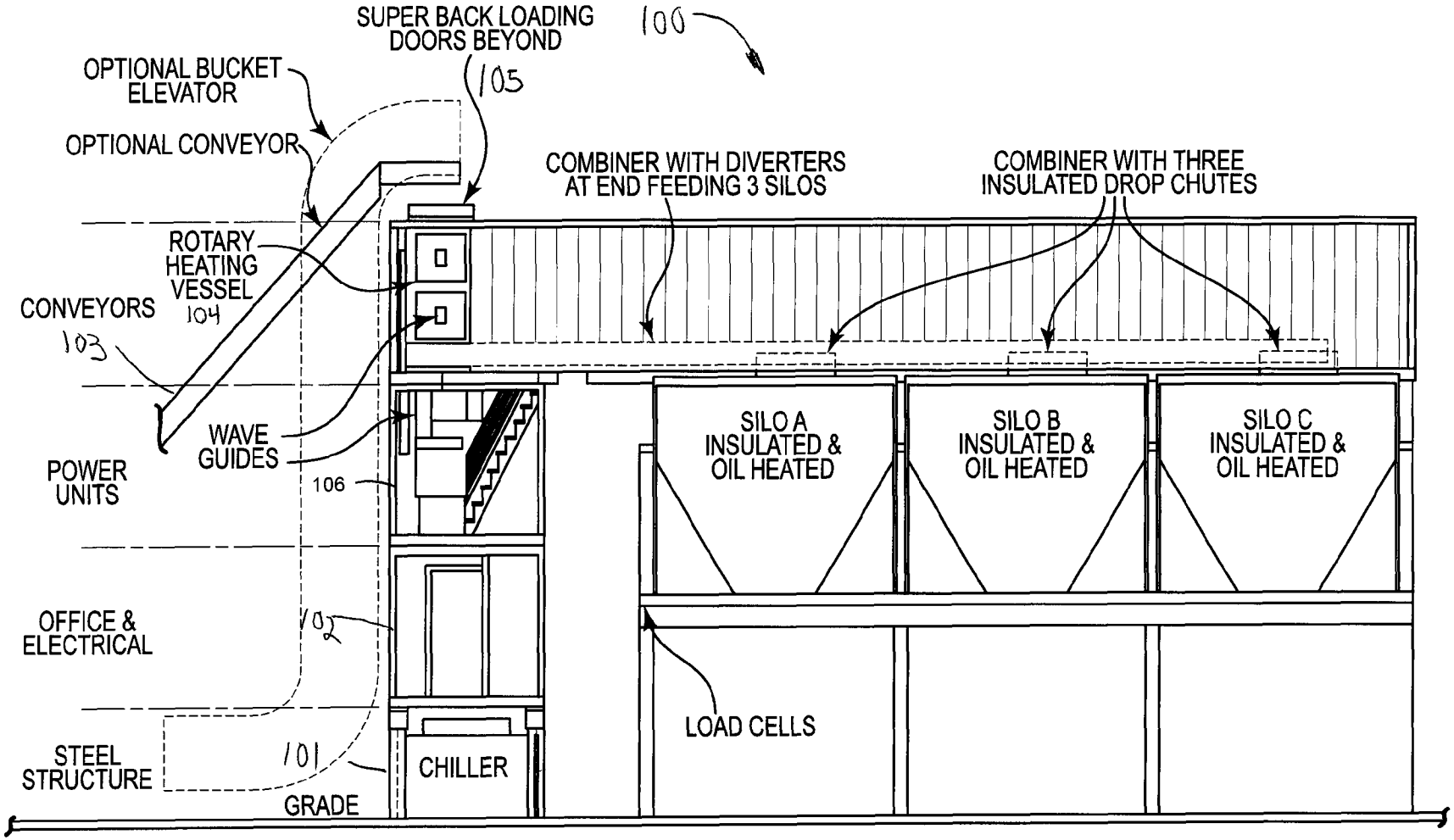
FIG. 10 illustrates various means of loading asphalt mix into the batch heating vessel.
Figure 11:
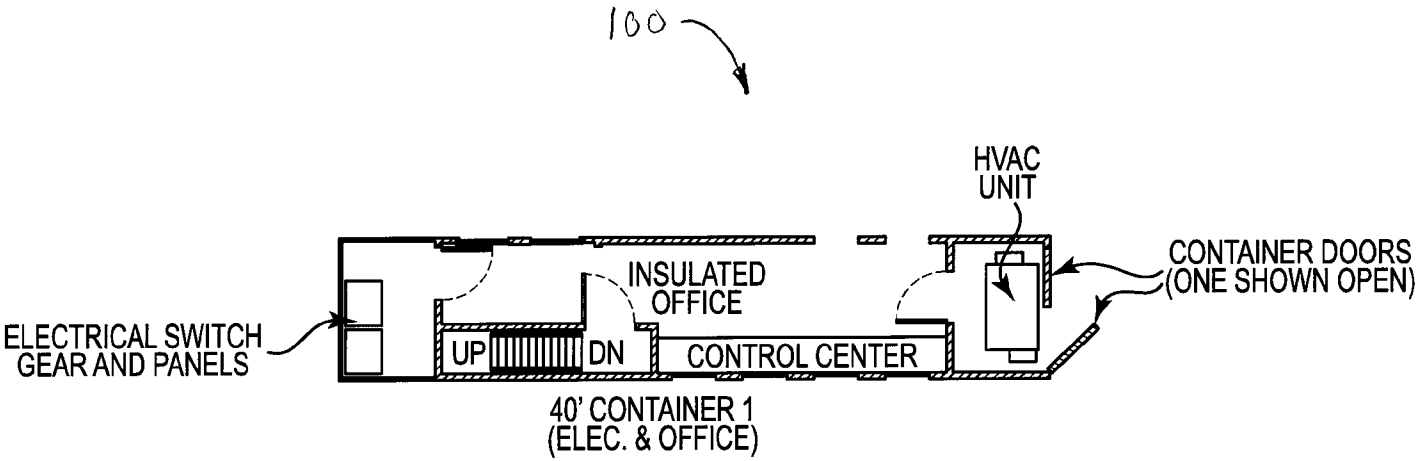
FIGS. 11-15 show additional views from different perspectives or the various levels of the modular asphalt mix plant with a LEHS of FIG. 9.
Figure 12:
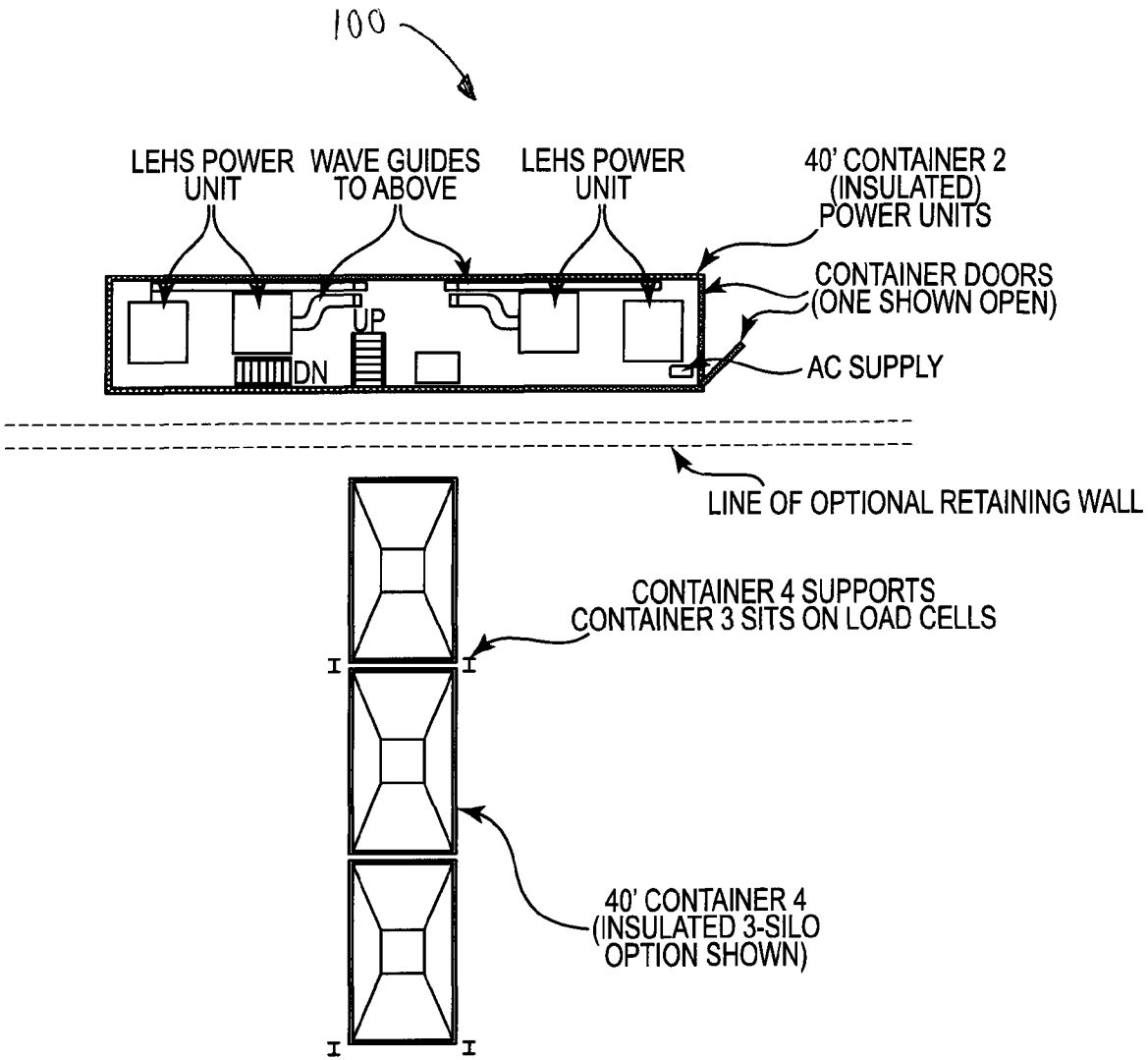
Figure 13:
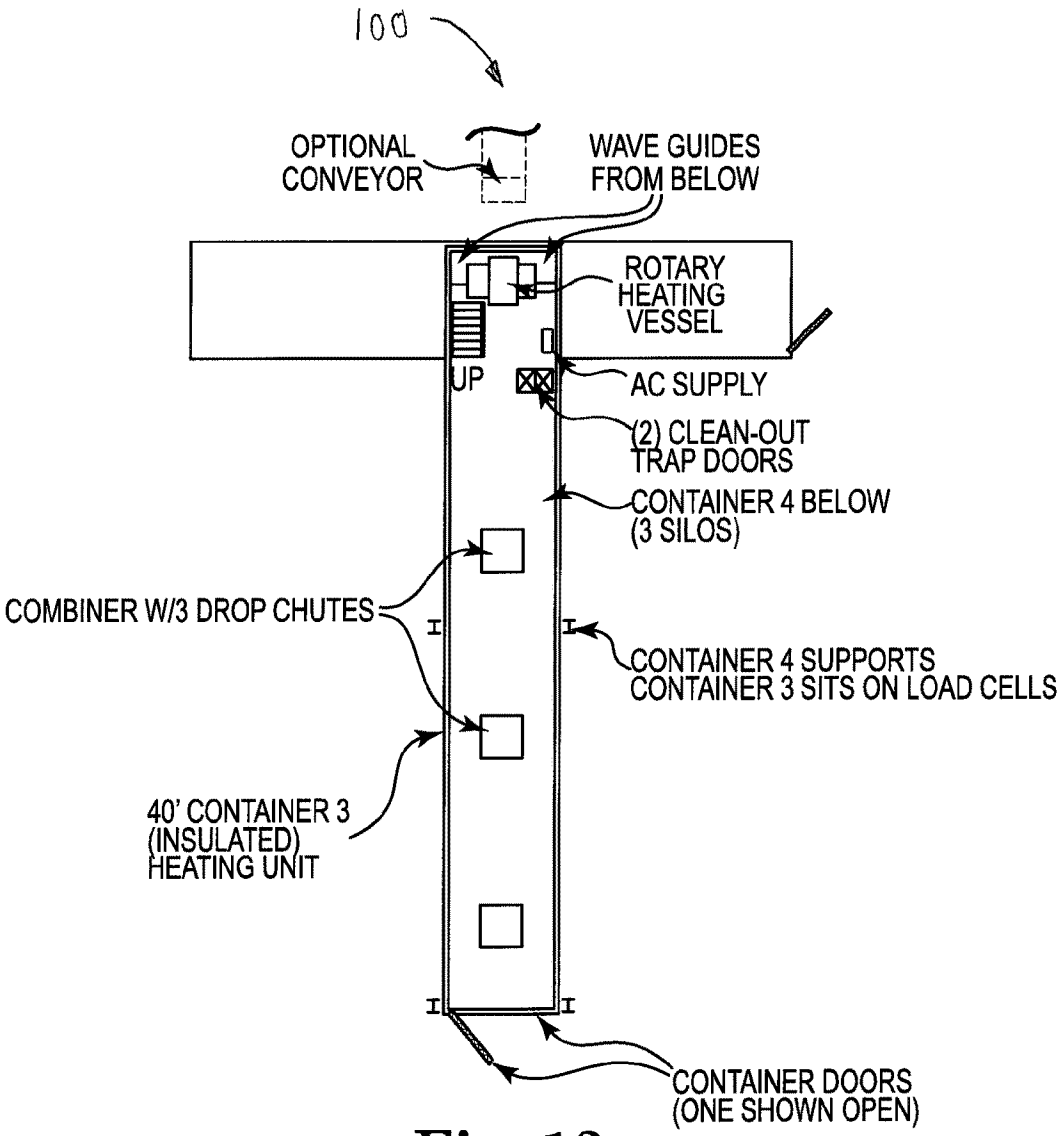
Figure 14:
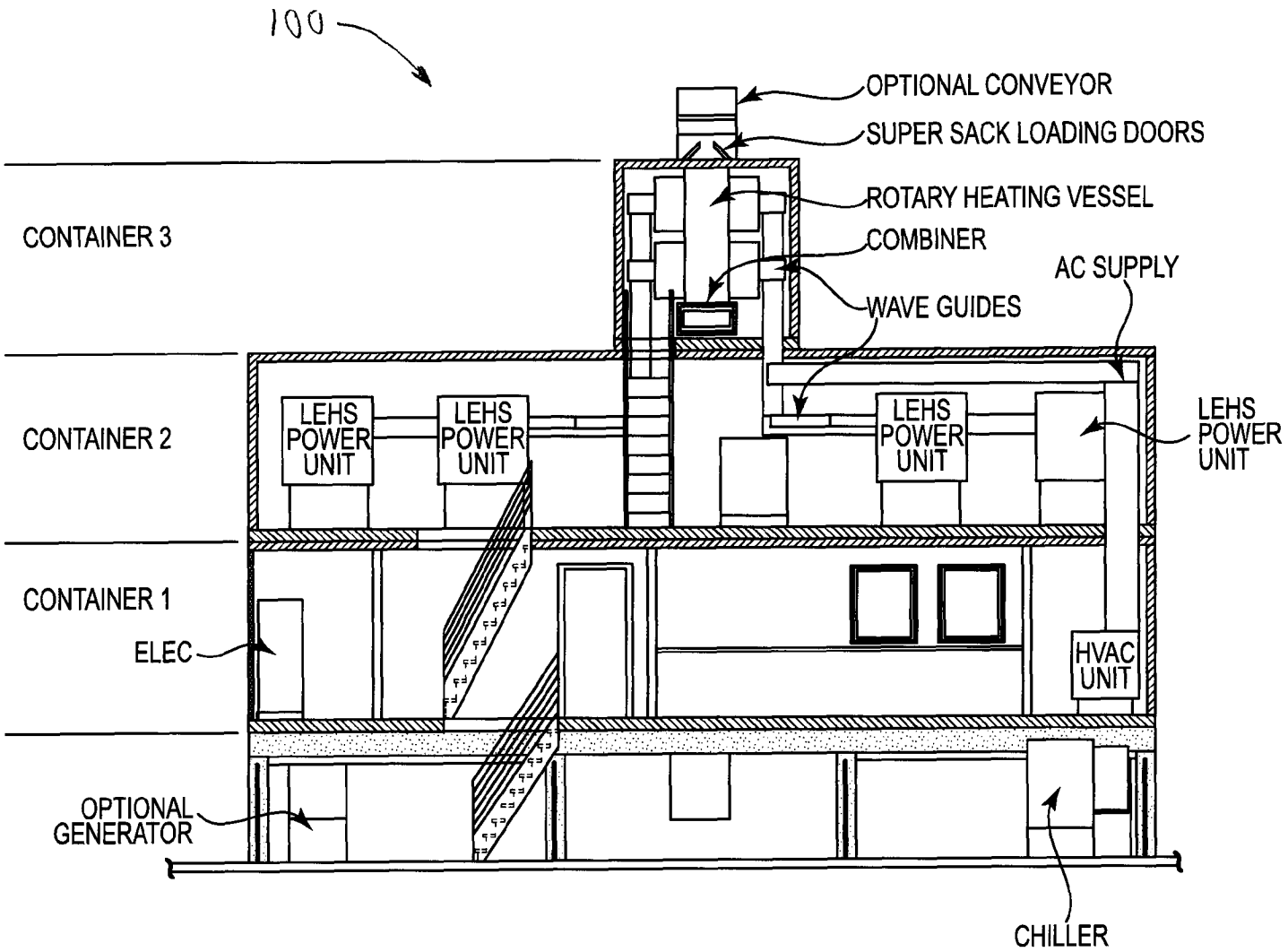
Figure 15:
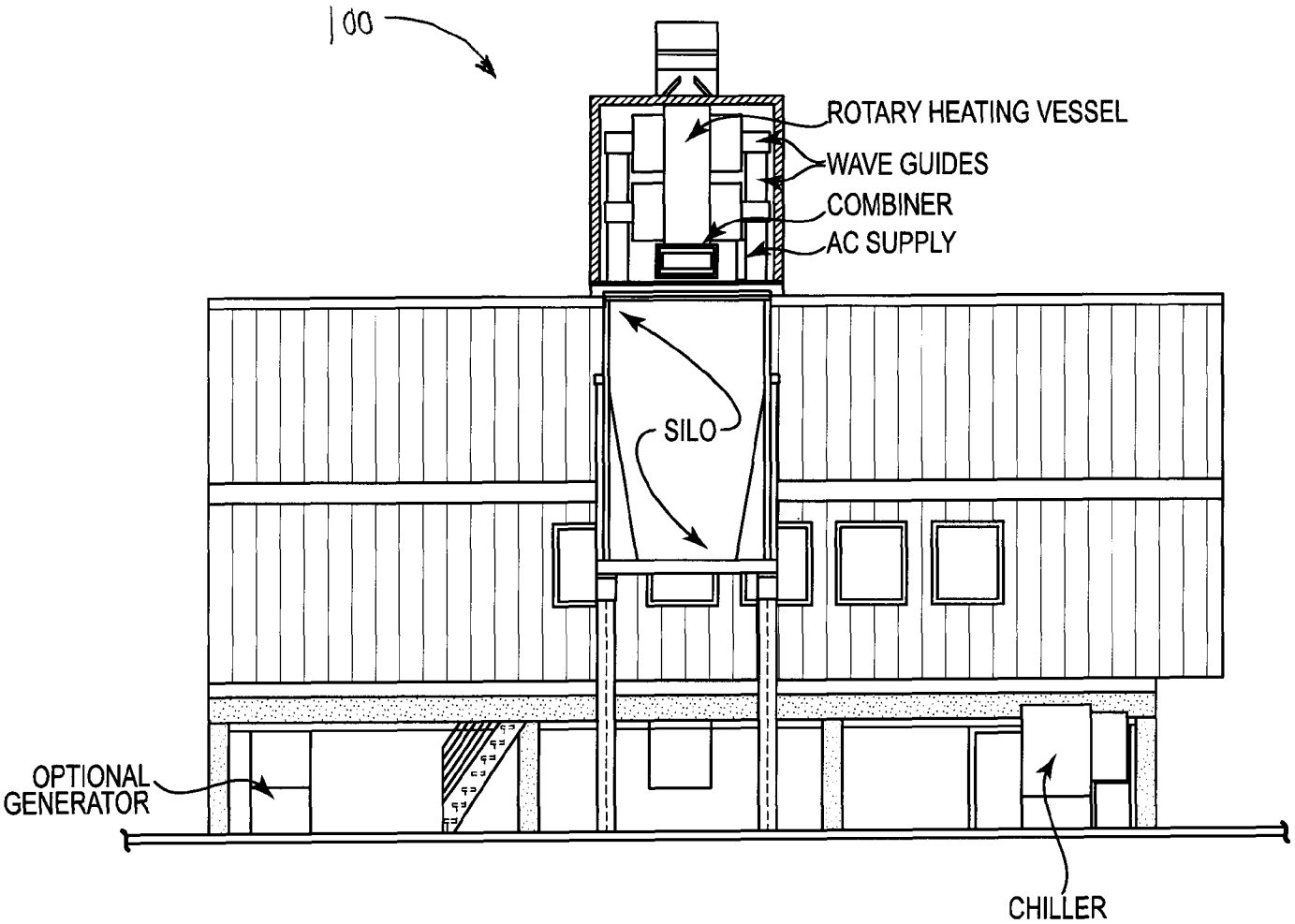

FIG. 10 is a side view of the modular asphalt mix plant with a LEHS shown in FIG. 9. The facilities section of the plant is comprised of roughly 4 levels. The bottom level 101 can store facility equipment such as a chiller unit that provides cooling for the microwave units described below, or for any other purpose. A generator can be housed on this level, to provide primary or back up electricity to the plant.

The second level 102 can include space for offices, as well as facility equipment such as the HVAC unit for heating and cooling any of the various areas of the plant including the vessel area as well as the office space.

FIG. 10 also illustrates various means of loading asphalt mix into the batch heating vessel 104. These include the use of a conveyor 103, either belt or paddle driven. Alternatively a bucket conveyor can be used as well. The top of the vessel includes loading doors 105 that can be opened and closed as needed to load asphalt mix, and to accommodate the heating step. As provided above, the asphalt mix may come from various sources such as aggregate, treated aggregate, RAP, RAS or combinations thereof.

At the second highest level 106 LEHS power units are located. The power units are electrically power and included a magnetron for generating microwave energy. Wave guides channel the microwave energy waves to the heating vessel. The microwaves can be introduced into to the vessel directly or using rotary joints.

FIGS. 11-15 show additional views from different perspectives or the various levels of the modular asphalt mix plant 100 with a LEHS shown in FIG. 9, and illustrate the matter disclosed above in additional detail.

Figure 16:
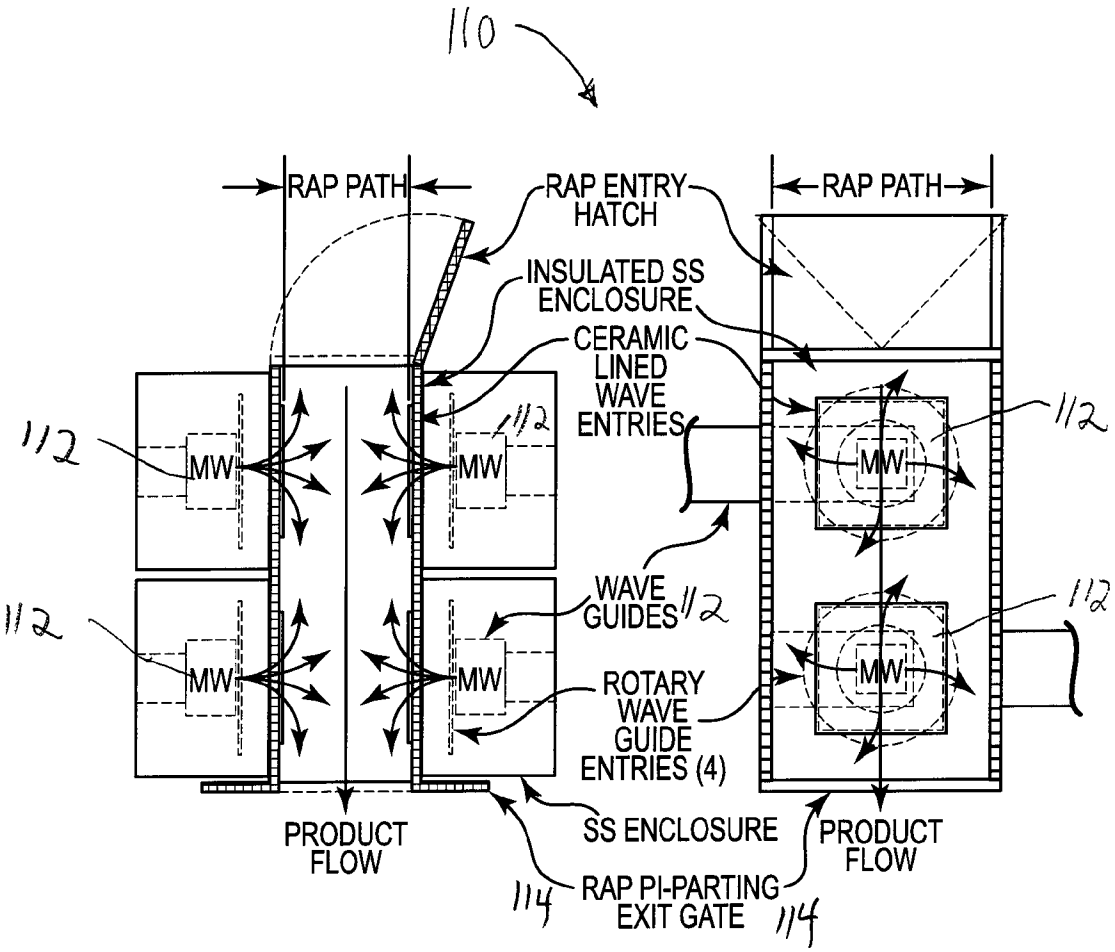
FIG. 16 is section and cross section views of a microwave heating vessel.

FIG. 16 shows section and cross section views of a microwave heating vessel 110, in which aggregate, treated aggregate RAP, RAS or combinations thereof is heated in batches by the LEHS microwave system. The aggregate, treated aggregate RAP, RAS or combinations thereof is loaded into the heating vessel from the top through doors 111 that can be opened for loading and closed for heating. Microwave energy enters the vessel from a variety of entry ports 112 to provide for distributing the energy throughout the heating vessel. The vessel is lined with a ceramic material, or some other similar material, that is not susceptible to heating when exposed to microwave energy, and is durable enough to handle asphalt mixt. After heating, exit gates 114 are opened to allow the heated finished asphalt mix to drop into the combiner or silo for storage of the heated finished asphalt mix. In FIG. 16, the four wave guides 112 are stacked on top of one another, however, they can be placed side-by-side, where there are four wave guides two on each side; however, the wave guides on arranged horizontally instead of vertically.

Figure 17:
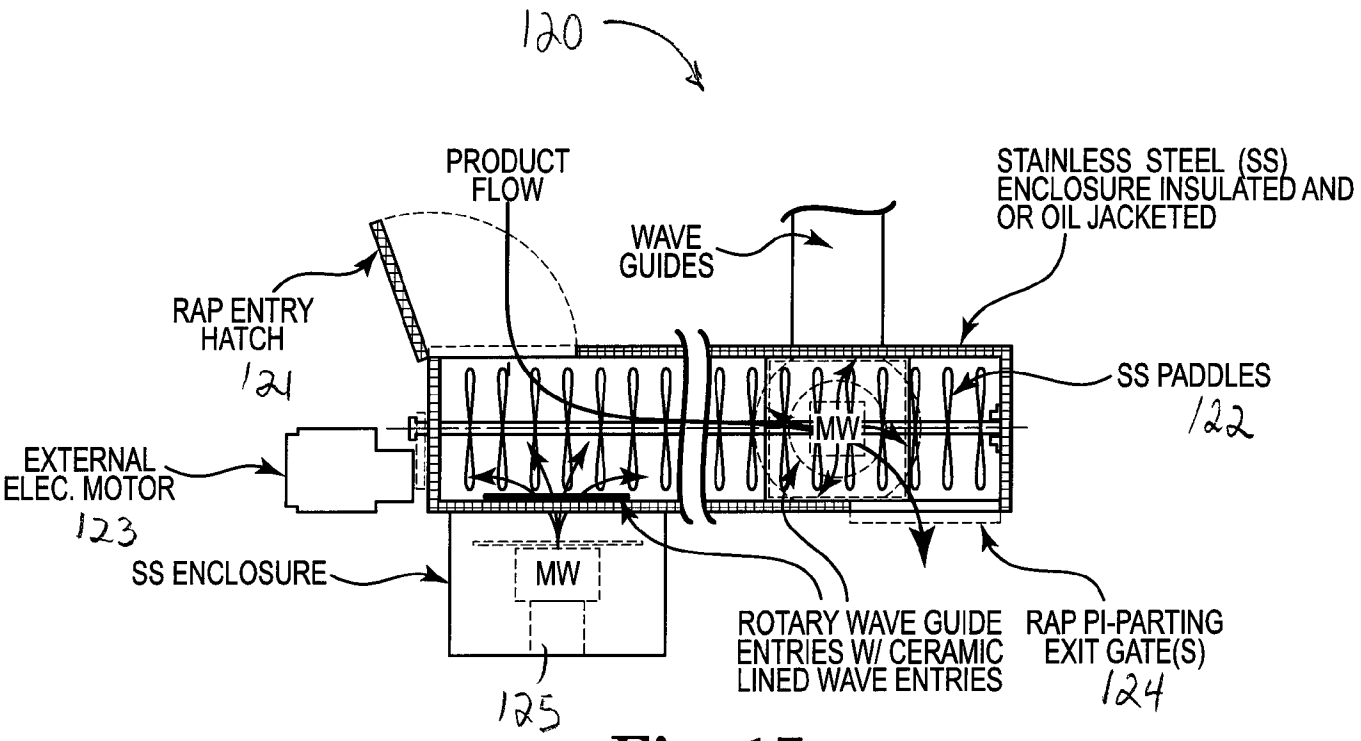
FIG. 17 is a side cross sectional view of a combiner.

FIG. 17 is a side cross sectional view of a combiner for the use in the disclosed asphalt mix plant. As described above, finished asphalt mix can move from the microwave heating vessel into the combiner 120 for distribution to the appropriate silo. Alternatively, the heating vessel can be omitted with the heating taking place in the combiner 120 by channeling the microwave energy through wave guides 125 connected at various locations along the length of the combiner.

The finished asphalt mix is introduced into the combiner 120 through a hatch 121 that can be open and closed as needed. A set of paddles 122 move the finished asphalt mix along the length of the combiner under the power of an electric motor 123. Exit gates 124 are located along the bottom of the combiner over the silos (not shown), which can be selectively opened and closed to fill the silos. The combiner 120 is preferably insulated to avoid heat loss, and lined with a material that is not susceptible to microwave heat such as stainless steel. Heated oil can be circulated through the lining of the combiner to heat the combiner to a temperature consistent with that of the finished asphalt mix.

The advantage of the present invention is that it greatly simplifies the components of an asphalt mix plant and in particular a mobile plant. By eliminating the need for a large costly heater the present invention greatly reduces the required infrastructure and cost associated with prior art plants. Further, the heating step is moved to the point of storage which also reduces the amount of infrastructure. For example, since heated asphalt mix is no longer moved on a conveyor, the conveyor experiences far less wear and tear which occurs when the belts move heated asphalt mix. The present invention allows for small cost effective mobile plants to be used in environments where it was not cost effective in the past. Still further, the present invention makes it possible for retail providers of cold mix asphalt to easily provide hot mix asphalt by reducing the cost of such a plant, and the space needed for a plant. The asphalt mix plant of the present invention can be used at a retail home center and the like to provide hot mix asphalt. Municipalities which lack the demand for a dedicated prior art asphalt mix plant, can now afford to have a plant or more easily set up a temporary mobile plant at any time instead of waiting until long periods of time until the demand justified the investment.

These and other advantages will be apparent to those of ordinary skill in the art.

While the various embodiments of the invention have been described, the invention is not so limited. Also, the method and apparatus of the present invention is not necessarily limited to any particular field, but can be applied to any field where an interface between a user and a computing device is applicable. There are two earlier filed and related U.S. patent applications, U.S. Ser. Nos. 13/887,828 and 13/887,859; the disclosures of which are hereby incorporated by reference.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods, and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention.

The invention claimed is:

1. A mobile batch asphalt mix plant, comprising:
- a trailer,
- an electric generator,
- a microwave energy system powered by the electric generator,
- a hopper configured to hold a quantity of unheated asphalt mix,
- one or more heating vessels,
- one or more wave guides configured to direct microwave energy from the microwave energy system into the one or more heating vessels for heating the asphalt mix,
- a conveyor configured to move unheated asphalt mix from the hopper to the one or more heating vessels for heating,
- one or more agitation mechanisms configured to blend at least the asphalt mix within the one or more heating vessels, and
- an elevated silo configured to receive heated asphalt mix from the one or more heating vessels as finished asphalt mix, the silo for storing the finished asphalt mix heated in the heating vessel with the microwave energy from the microwave energy system, and the silo positioned below at least one of the one or more heating vessels.

2. The mobile batch asphalt mix plant of claim 1, wherein the asphalt mix comprises aggregate, asphalt emulsion, asphalt binder or binder component(s), softening or rejuvenating oil, aggregate blend, asphalt blend, treated aggregate, RAP, RAS, 100% RAP, or combinations thereof.

3. The mobile batch asphalt mix plant of claim 1, wherein the microwave energy system comprises a single microwave transmitter or a plurality of microwave transmitters.

4. The mobile batch asphalt mix plant of claim 1, wherein at least one of asphalt binder or asphalt emulsion is added to the asphalt mix.

5. The mobile batch asphalt mix plant of claim 4, wherein the at least one of asphalt binder or asphalt emulsion is added to the asphalt mix within the one or more heating vessels.

6. The mobile batch asphalt mix plant of claim 5, wherein the one or more agitation mechanisms are configured to blend the asphalt mix, including the added asphalt binder or asphalt emulsion, during heating.

7. The mobile batch asphalt mix plant of claim 6, wherein the one or more agitation mechanisms comprise a plurality of paddles that move the asphalt mix, including the added asphalt binder or asphalt emulsion, from one side of the heating vessel to another side of the heating vessel during heating.

8. The mobile batch asphalt mix plant of claim 1, further comprising a combiner, wherein the combiner is a pug mill configured to blend the heated finished asphalt mix before being moved to the silo for storage.

9. The mobile batch asphalt mix plant of claim 1, wherein the one or more wave guides are positioned along a side of and/or under the conveyor.

10. The mobile batch asphalt mix plant of claim 1, wherein the one or more wave guides are attached to the conveyor.

11. The mobile batch asphalt mix plant of claim 1, wherein the one or more heating vessels comprises at least a drum dryer heater.

12. The mobile batch asphalt mix plant of claim 1, wherein the one or more agitation mechanisms are configured to blend at least the asphalt mix within the one or more heating vessels during heating.

13. The mobile batch asphalt mix plant of claim 1, wherein the elevated silo is configured to dispense finished asphalt mix into one or more trucks that can drive under the elevated silo.

14. A stationary batch asphalt mix plant, comprising:
- a source of electricity,
- a microwave energy system powered by the source of electricity,
- a hopper configured to hold a quantity of unheated asphalt mix,
- one or more heating vessels,
- one or more wave guides configured to direct microwave energy from the microwave energy system into the one or more heating vessels for heating the asphalt mix,
- a conveyor configured to move unheated asphalt mix from the hopper to the one or more heating vessels for heating,
- one or more agitation mechanisms configured to blend at least the asphalt mix within the one or more heating vessels, and
- an elevated silo configured to receive heated asphalt mix from the one or more heating vessels as finished asphalt mix, the silo for storing the finished asphalt mix heated in the heating vessel with the microwave energy from the microwave energy system, and the silo positioned below at least one of the one or more heating vessels.

15. The stationary batch asphalt mix plant of claim 14, wherein the asphalt mix comprises aggregate, asphalt emulsion, asphalt binder or binder component(s), softening or rejuvenating oil, aggregate blend, asphalt blend, treated aggregate, RAP, RAS, 100% RAP, or combinations thereof.

16. The stationary batch asphalt mix plant of claim 14, wherein the microwave energy system comprises a single microwave transmitter or a plurality of microwave transmitters.

17. The stationary batch asphalt mix plant of claim 14, further comprising a combiner, wherein the combiner is a pug mill to blend the heated finished asphalt mix before being moved to the silo for storage.

18. The stationary batch asphalt mix plant of claim 14, wherein at least one of asphalt binder or asphalt emulsion is added to the asphalt mix.

19. The stationary batch asphalt mix plant of claim 18, wherein the at least one of asphalt binder or asphalt emulsion is added to the asphalt mix within the one or more heating vessels.

20. The stationary batch asphalt mix plant of claim 19, wherein the one or more heating vessels contain agitation mechanisms configured to blend the asphalt mix and the added asphalt binder or asphalt emulsion during heating.

21. The stationary batch asphalt mix plant of claim 20, wherein the one or more agitation mechanisms comprise a plurality of paddles that move the asphalt mix and the added asphalt binder or asphalt emulsion from one side of the heating vessel to another side of the heating vessel during heating.

22. The stationary batch asphalt mix plant of claim 14, wherein the one or more agitation mechanisms are configured to blend at least the asphalt mix within the one or more heating vessels during heating.

* * * * *